US008881314B2

(12) United States Patent
McCombs

(10) Patent No.: US 8,881,314 B2
(45) Date of Patent: Nov. 11, 2014

(54) LOWER BODY GARMENT WITH TWO SLIDER INVISIBLE ZIPPER

(76) Inventor: Kelly McCombs, Seattle, WA (US)

( * ) Notice: Subject to any disclaimer, the term of this patent is extended or adjusted under 35 U.S.C. 154(b) by 56 days.

(21) Appl. No.: 13/441,191

(22) Filed: Apr. 6, 2012

(65) Prior Publication Data

US 2013/0263353 A1 Oct. 10, 2013

(51) Int. Cl.
*A41D 1/02* (2006.01)

(52) U.S. Cl.
USPC ..... 2/227; 2/79

(58) Field of Classification Search
USPC ..... 2/79, 227, 228, 408, 234
See application file for complete search history.

(56) References Cited

U.S. PATENT DOCUMENTS

| | | | | | |
|---|---|---|---|---|---|
| 2,138,230 | A | * | 11/1938 | Friedman | 2/71 |
| 2,166,514 | A | * | 7/1939 | Zapis | 2/67 |
| 2,277,068 | A | * | 3/1942 | Bulloch | 2/408 |
| 2,468,346 | A | * | 4/1949 | Rayden | 450/105 |
| 2,519,202 | A | * | 8/1950 | Slater | 2/234 |
| 2,522,421 | A | * | 9/1950 | Wolf | 2/80 |
| 2,552,875 | A | * | 5/1951 | Stein | 2/408 |
| 4,578,828 | A | * | 4/1986 | Smith et al. | 2/234 |
| 4,604,761 | A | * | 8/1986 | Wright | 2/227 |
| 5,010,595 | A | * | 4/1991 | Stradley | 2/227 |
| 5,033,126 | A | * | 7/1991 | Wruck et al. | 2/242 |
| 5,586,339 | A | * | 12/1996 | Lathan | 2/46 |
| 5,598,586 | A | * | 2/1997 | Munjone | 2/237 |
| 5,983,401 | A | * | 11/1999 | Ohara | 2/227 |
| 6,161,223 | A | * | 12/2000 | Andrews | 2/234 |
| 6,243,878 | B1 | * | 6/2001 | Khemka et al. | 2/227 |
| 6,789,269 | B1 | * | 9/2004 | Scovin | 2/227 |
| 6,941,584 | B1 | * | 9/2005 | Matthews | 2/234 |
| 6,944,883 | B1 | | 9/2005 | Cuaz | |
| 7,926,122 | B1 | * | 4/2011 | Countryman | 2/227 |
| 2002/0040496 | A1 | * | 4/2002 | Blaire | 2/227 |
| 2006/0174399 | A1 | * | 8/2006 | Nikolayev et al. | 2/227 |
| 2011/0167537 | A1 | * | 7/2011 | Christoff | 2/228 |

* cited by examiner

*Primary Examiner* — Richale Quinn
(74) *Attorney, Agent, or Firm* — Puget Patent; Michael Gibbons

(57) ABSTRACT

A lower body garment with an extended invisible zipper that extends past the perineum. The zipper may extend further upwards along the posterior of the wearer, perhaps to the waistline. The zipper is an invisible zipper having two sliders, a first slider which may unzip from the front to the back, and a second slider which may unzip from the back to the front. One or both sliders may tuck into a compartment, which in conjunction with the invisible zipper construction prevent others from knowing the wearer's pants may be unzipped from the rear. A flap may cover the chain of the zipper on the inside of the pants. A system may include pants or shorts with a two slider invisible zipper, and underwear including a flap from front to back forming an aperture sized the same as the aperture in the pants at the zipper.

20 Claims, 8 Drawing Sheets

23

LOWER BODY GARMENT WITH TWO SLIDER INVISIBLE ZIPPER

FIELD OF THE INVENTION

This invention relates generally to garments, and more specifically, to a lower body garment with a two slider invisible zipper.

BACKGROUND

A pair of pants or other lower body garment commonly has a zipper used to secure the pants around the waist. Located at the front of the body, in front of the lower abdomen and extending between the legs to approximately the perineum, the zipper also permits a male wearer to urinate by merely unzipping the zipper, without having to draw the pants down below the waist. A woman wearing such pants who unzips the zipper, however, cannot relieve herself through the aperture created by the zipper being unzipped. The woman must draw the pants down below the waist to the knees to urinate.

In certain scenarios, a woman may not wish to draw the pants down to the knees to relieve herself. For example, a female participant in an outdoor activity during the wintertime, such as cross-country skiing, who wishes to urinate outdoors must expose her posterior to the cold air to do so, where a male could merely unzip the zipper of the pants.

Pants that have an extended zipper which extends past the perineum and along the buttocks all the way to the waistline of the wearer in the rear would be advantageous. The extended zipper would permit a female wearer to open an aperture in the pants sufficiently large enough to relieve herself without having to draw the pants down to the knees, leaving the pants in place around the waist while urinating to retain more warmth than would be possible if the pants were pulled all the way down.

Other scenarios for both women and men are envisioned where pants with such an extended zipper would be advantageous. For example, it may be that the wearer's shirt is neatly tucked into the pants just perfectly, and the wearer does not want to draw the pants down to the knees because that will result in having to take the time to neatly tuck the shirt into the pants again. Or, it could be that the wearer wants to provide access to the body to another person, for sexual activity, medical purposes, or for other reasons. Such reasons might include providing access to the back, but not the front, of the body. In a different scenario, the wearer may be wearing a belt with hanging accessories, such as a tool belt, where a bathroom stop might otherwise require the wearer to remove the tool belt prior to dropping the pants. With the extended zipper, a male wearer who needs to sit on the toilet may do so without removing a tool belt. In fact, it should be noted that all of the foregoing examples may be viewed as gender-neutral.

Further, the wearer may want to open only the back of the pants, or may prefer to open the zipper from rear to front, instead of from front to rear. Pants having a zipper with two sliders would be advantageous. Yet while advantages of the two-way extended zipper exist, the wearer may not always wish others to know that the pants can be unzipped in the rear. The wearer may want the pants with an extended zipper to retain the appearance of pants with the usual zipper and not have unusual oversized flaps, Velcro enclosures, or the like.

Accordingly, what is needed is a lower body garment with a two slider invisible zipper.

SUMMARY

This invention relates generally to garments, and more specifically, to a lower body garment with a two slider invisible zipper. In some embodiments, a lower body garment with a two slider invisible zipper may include an invisible zipper, the invisible zipper having a first slider and a second slider, the first and second sliders operable to open and shut the chain of the invisible zipper. The exemplary embodiment may further include a waistband, a left leg portion and a right leg portion. The waistband surrounds the waist of the wearer, encircling the wearer from front to rear, with the left leg and right leg portions joined to the waistband.

In some embodiments, the left and right leg portions and are divided in between the legs of the wearer by a seam. The seam is defined at least in part by the invisible zipper. The invisible zipper couples the left and right leg portions beginning at a front portion of the waistband and extending downwards along the seam between the left and right leg portions, through at least the crotch portion, continuing past the perineum portion upwards all the way to the point just below the rear of the waistband, the invisible zipper defining the seam between the left and right leg portions all the way from the waistband at its front to the waistband at its rear.

In some embodiments, the invisible zipper is not visible from the exterior of the garment when the invisible zipper is closed. The construction of the left and right leg portions and of the garment in the vicinity of the seam is such that the invisible zipper is hidden from view when the invisible zipper is closed.

In some embodiments, the lower body garment with a two slider invisible zipper may have a compartment, the compartment operable to conceal a rear zipper pull (the rear zipper pull coupled to the second slider of the invisible zipper), the compartment being located directly below a rear portion of the waistband, at a closed position for the second slider.

In some embodiments, the compartment is disposed directly below the bottom portion of the waistband. At least a portion of the left and right portions and of the garment, including the folds in the left and right portions and of the garment, are stitched together at the seam to define the compartment. When the second slider is at the closed position for the second slider, the left and right portions of the garment that are stitched together cover the second slider. Below the compartment, the folds in the left and right portions and of the garment are not stitched together, allowing the left and right portions to separate when the invisible zipper is opened.

In some embodiments, the invisible zipper is constructed by coupling the left and right portions and of the garment with the left and right zipper tapes and of the invisible zipper. Particularly, the left and right portions of the garment are folded over, creating a left interior flap and right interior flap. The left and right zipper tapes and are stitched to the left and right interior flaps. This construction defines the invisible zipper, in which the left and right interior flaps lay on the exterior of the invisible zipper, making the line along which the invisible zipper runs appear to be a fixed seam and concealing the invisible zipper from exterior view. The sliders slide along the zipper tapes and behind the interior flaps. The zipper pulls sit in between the zipper tapes and the interior flaps.

In some embodiments, the compartment is formed just below the rear portion of the waistband. The compartment is disposed at the closed position for the second slider, and is sized to hide at least the second zipper pull of the second slider when the second slider is at the closed position for the second slider. The compartment is formed by a stitch that couples the left and right interior flaps for a length at least as long as the second zipper pull.

BRIEF DESCRIPTION OF THE DRAWINGS

Embodiments of the present invention are described in detail below with reference to the following drawings.

DETAILED DESCRIPTION

This invention relates generally to garments, and more specifically, to a lower body garment with a two slider invisible zipper. Specific details of certain embodiments of the invention are set forth in the following description, FIGS. 1-5 and in the APPENDIX to provide a thorough understanding of such embodiments. The present invention may have additional embodiments, may be practiced without one or more of the details described for any particular described embodiment, or may have any detail described for one particular embodiment practiced with any other detail described for another embodiment.

Figure 1A:
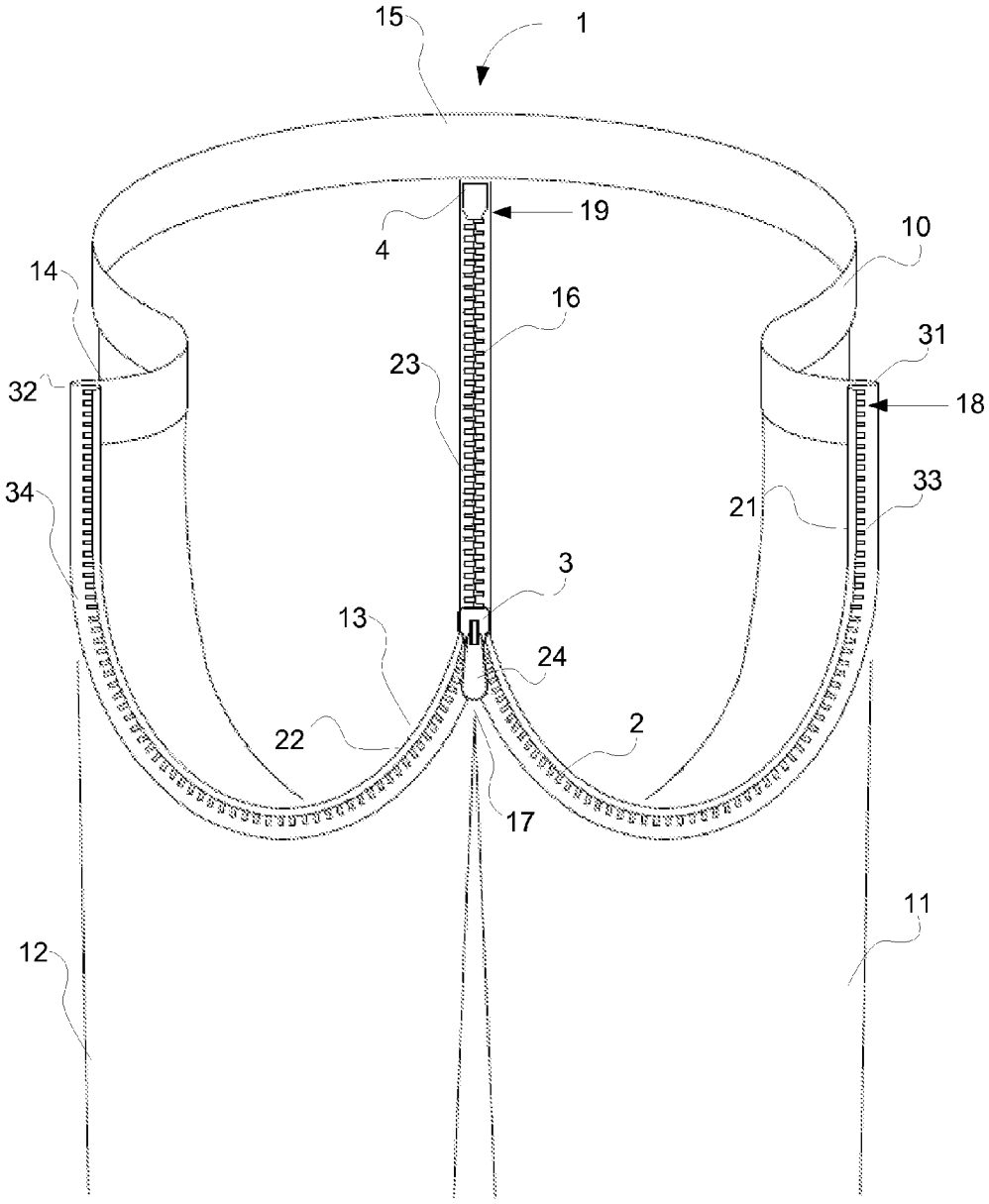
FIGS. 1*a* and 1*b* are front views of a lower body garment with a two slider invisible zipper, in accordance with an embodiment of the invention.
Figure 1B:
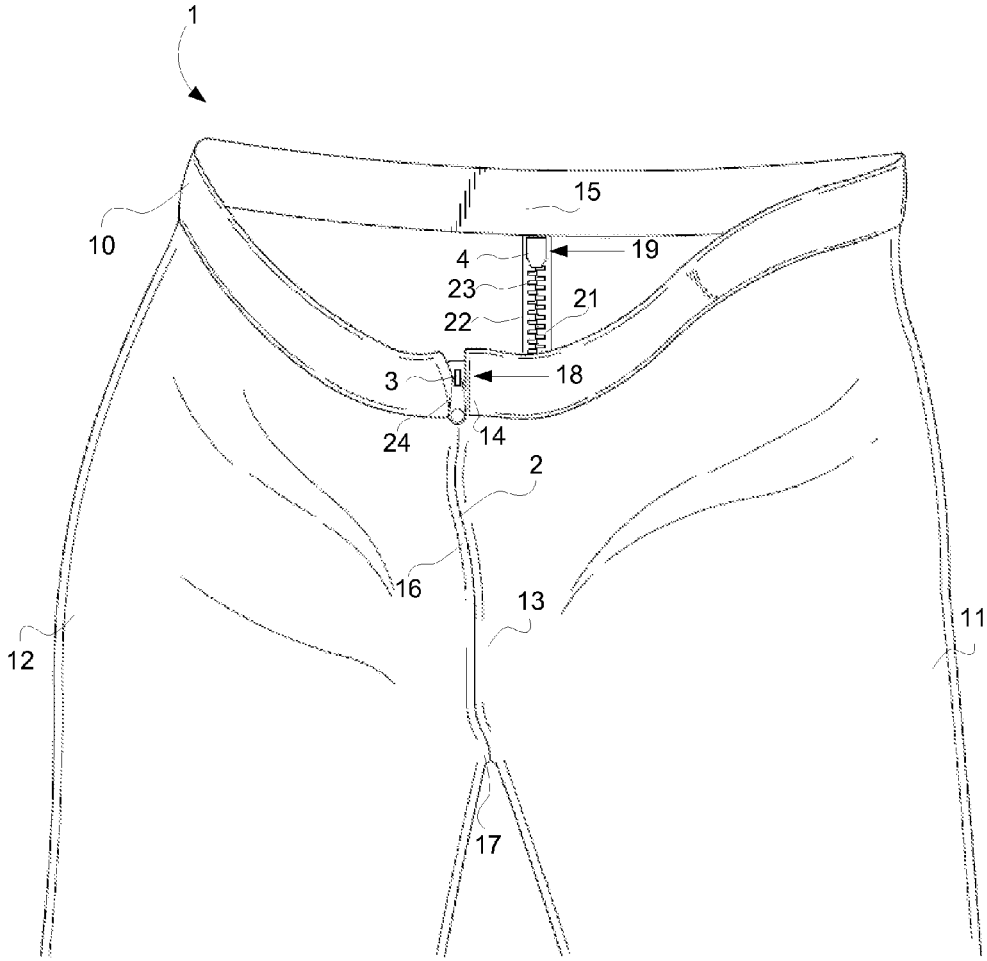

FIGS. 1*a* and 1*b* are front views of a lower body garment with a two slider invisible zipper 1, in accordance with an embodiment of the invention. FIG. 1*a* depicts the garment with an open invisible zipper, and FIG. 1*b* depicts the garment with a closed invisible zipper. In some embodiments, a lower body garment with a two slider invisible zipper may be a pair of pants. In different embodiments, a lower body garment with a two slider invisible zipper may be another type of garment. For example, in some embodiments, a garment with compartments may be shorts, or any other garment worn on the lower body.

In the exemplary embodiment, a lower body garment with a two slider invisible zipper 1 may include an invisible zipper 2, the invisible zipper having a first slider 3 and a second slider 4, the first and second sliders operable to open and shut the chain 23 of the invisible zipper. The exemplary embodiment may further include a waistband 10, a left leg portion 11 and a right leg portion 12. The waistband surrounds the waist of the wearer, encircling the wearer from front to rear, with the left leg and right leg portions joined to the waistband.

In some embodiments, the left and right leg portions 11 and 12 are divided in between the legs of the wearer by a seam 16. The seam is defined at least in part by the invisible zipper 2. The invisible zipper couples the left and right leg portions beginning at a front portion 14 of the waistband and extending downwards along the seam between the left and right leg portions, through at least the crotch portion 13, the crotch portion dividing the left and right leg portions, and to at least a perineum portion 17, the perineum portion being the portion of the seam in the vicinity (vicinity meaning from zero to four inches in either direction along the seam) of the perineum of the wearer. In some embodiments the invisible zipper may end at the perineum portion, with the seam 16 continuing upward to a point just below the rear portion 15 of the waistband. In a preferred embodiment the invisible zipper continues past the perineum portion upwards all the way to the point just below the rear of the waistband, the invisible zipper defining the seam between the left and right leg portions all the way from the waistband at its front to the waistband at its rear. While the closed position of the first slider, and thus the first end of the invisible zipper, will usually be at the front of the waistband, in some embodiments the end of the invisible zipper opposite the first end may be at any point in between the perineum portion and the rear of the waistband.

In some embodiments, the invisible zipper 2 is not visible from the exterior of the garment when the invisible zipper is closed. The construction of the left and right leg portions 11 and 12 of the garment in the vicinity of the seam 16 is such that the invisible zipper is hidden from view when the invisible zipper is closed. The invisible zipper is hidden by left and right interior flaps 33 and 34 of the garment, the flaps being defined by folds 31 and 32 in the left and right leg portions of the garment. The aforementioned construction will be discussed further relative to FIGS. 3*a* and 3*b*. In some embodiments, the invisible zipper further comprises left and right zipper tapes 21 and 22, a zipper chain 23 which is coupled to the left and right zipper tapes 21 and 22, and the first and second sliders 3 and 4. The left zipper tape is coupled with the left leg portion of the garment at the seam, and the right zipper tape is coupled with the right leg portion of the garment at the seam.

In some embodiments, the first and second sliders 3 and 4 of the invisible zipper 2 may slide along the entire length of the zipper chain 23. In some embodiments, when the first and second sliders are at first and second slider closed positions 18 and 19, the invisible zipper is closed and the left leg and right leg portions 11 and 12 are coupled at the seam 16. In some embodiments, the first slider closed position 18 is at the front of the waistband. In some embodiments, the second slider closed position 19 is at the end of the zipper opposite the front of the waistband. In some embodiments, the second slider closed position 19 is just below the rear of the waistband 15.

In some embodiments, the first slider 3 may have a first zipper pull 24 coupled to the first slider. In some embodiments, the second slider 4 may have a second zipper pull 25 (not depicted in FIGS. 1*a* and 1*b* but visible in, for example, FIG. 2*a*) coupled to the second slider. The first and second zipper pulls will generally be accessible from the exterior of the garment. In some embodiments, the garment may have an elastic or other expandable strap sewn into the waistband, the strap having a fastex or other snap-lock buckle providing an additional closure of the garment around the waist. In some embodiments, the buckle additionally conceals the first zipper pull between the buckle and the garment. In some embodiments, the invisible zipper 2 is a waterproof zipper. In some embodiments, the first slider and second slider have zipper pulls configured for enabling a wearer to open or close the invisible zipper, the zipper pulls being sized such that they may be pulled by a wearer wearing one of mittens or gloves.

Figure 2A:
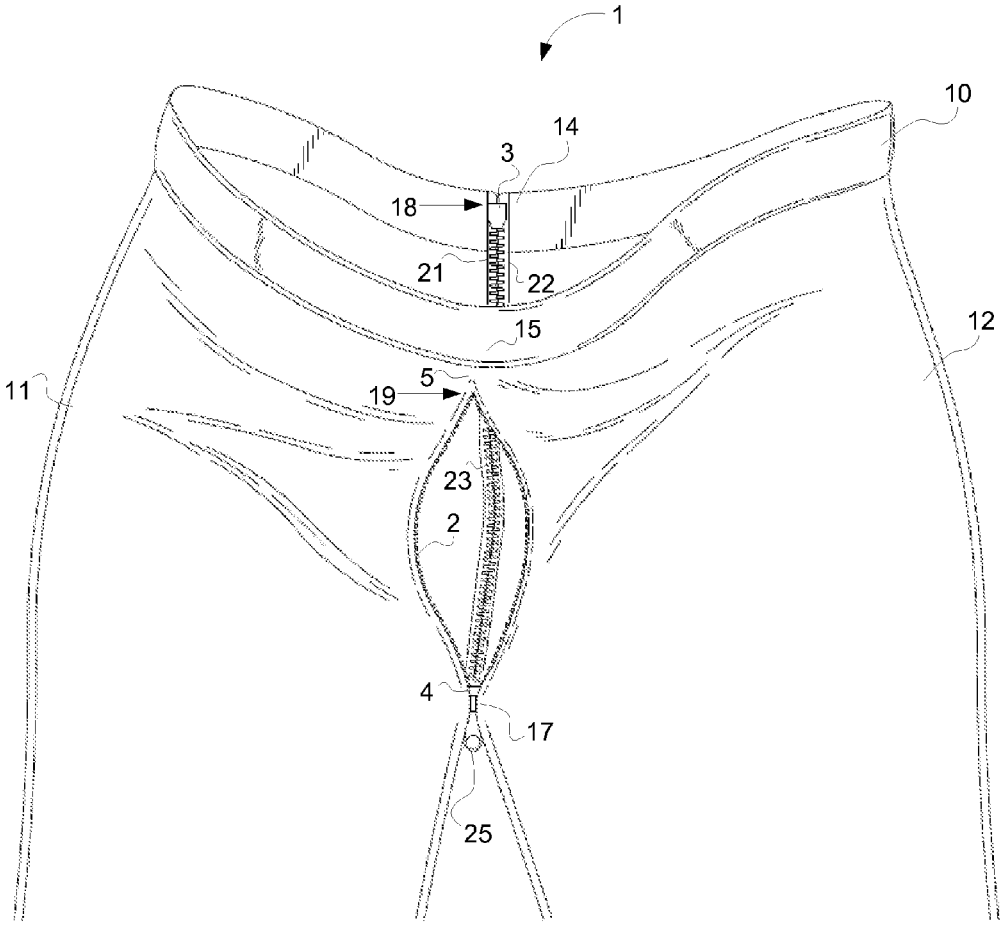
FIGS. 2*a*, 2*b* and 2*c* are rear views of a lower body garment with a two slider invisible zipper, in accordance with an embodiment of the invention.
Figure 2B:
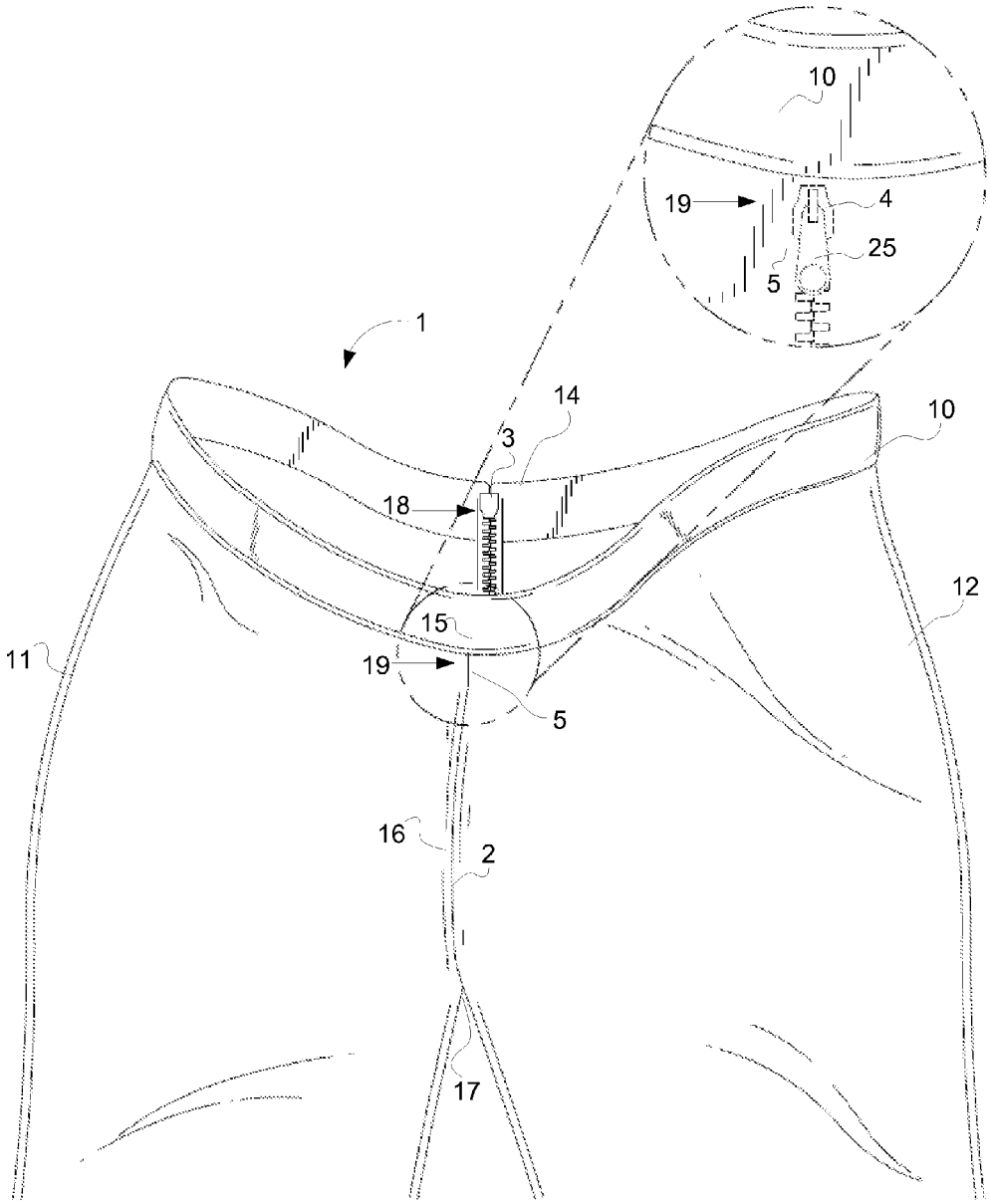
Figure 2C:
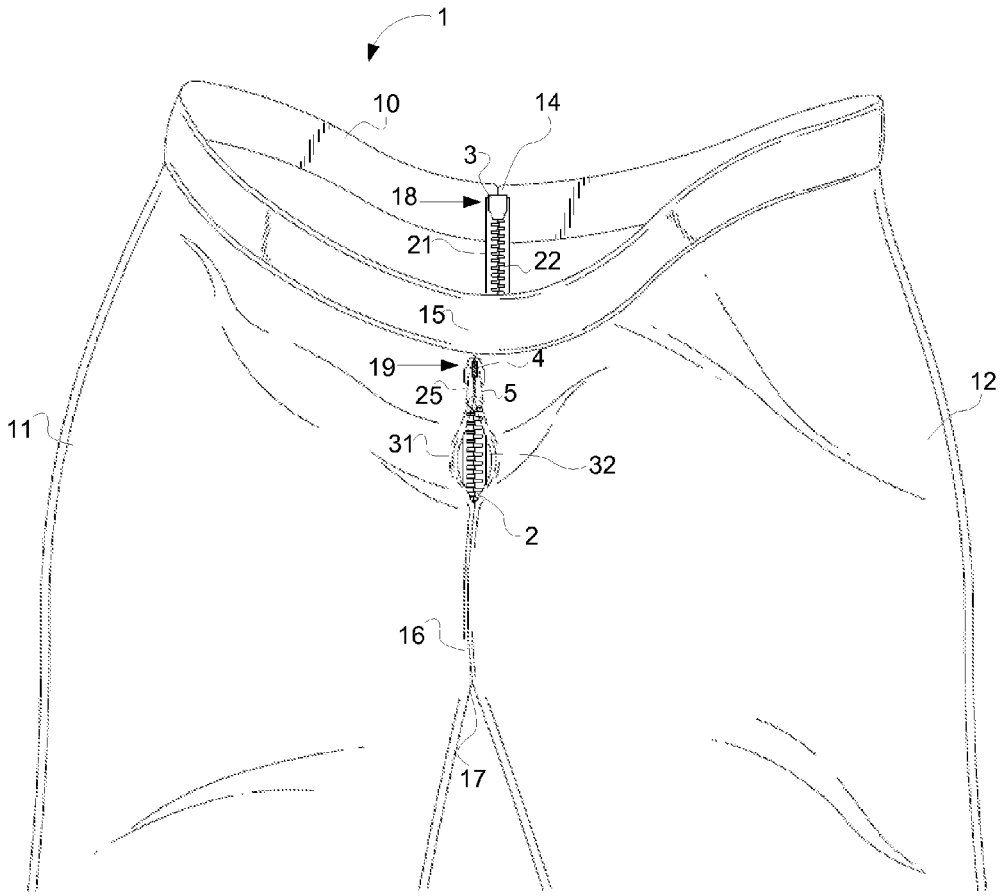

FIGS. 2*a*, 2*b* and 2*c* are rear views of a lower body garment with a two slider invisible zipper, in accordance with an embodiment of the invention. In some embodiments, the lower body garment with a two slider invisible zipper 1 may have a compartment 5, the compartment operable to conceal a rear zipper pull 25 (the rear zipper pull coupled to the second slider 4 of the invisible zipper 2), the compartment being located directly below a rear portion 15 of the waistband 10, at a closed position for the second slider 19. It will be understood that the second slider may slide along the length of the invisible zipper, from the rear portion of the waistband in some embodiments beyond the perineum portion 17 and all the way to the front portion 14 of the waistband.

In some embodiments, the compartment 5 is disposed directly below the bottom portion 15 of the waistband 10. At least a portion of the left and right portions 11 and 12 of the garment, including the folds in the left and right portions 31 and 32 of the garment, are stitched together at the seam 16 to define the compartment. When the second slider 4 is at the closed position 19 for the second slider, the left and right portions of the garment that are stitched together cover the second slider. Below the compartment, the folds in the left and right portions 31 and 32 of the garment are not stitched together, allowing the left and right portions to separate when the invisible zipper 2 is opened.

Figure 3A:
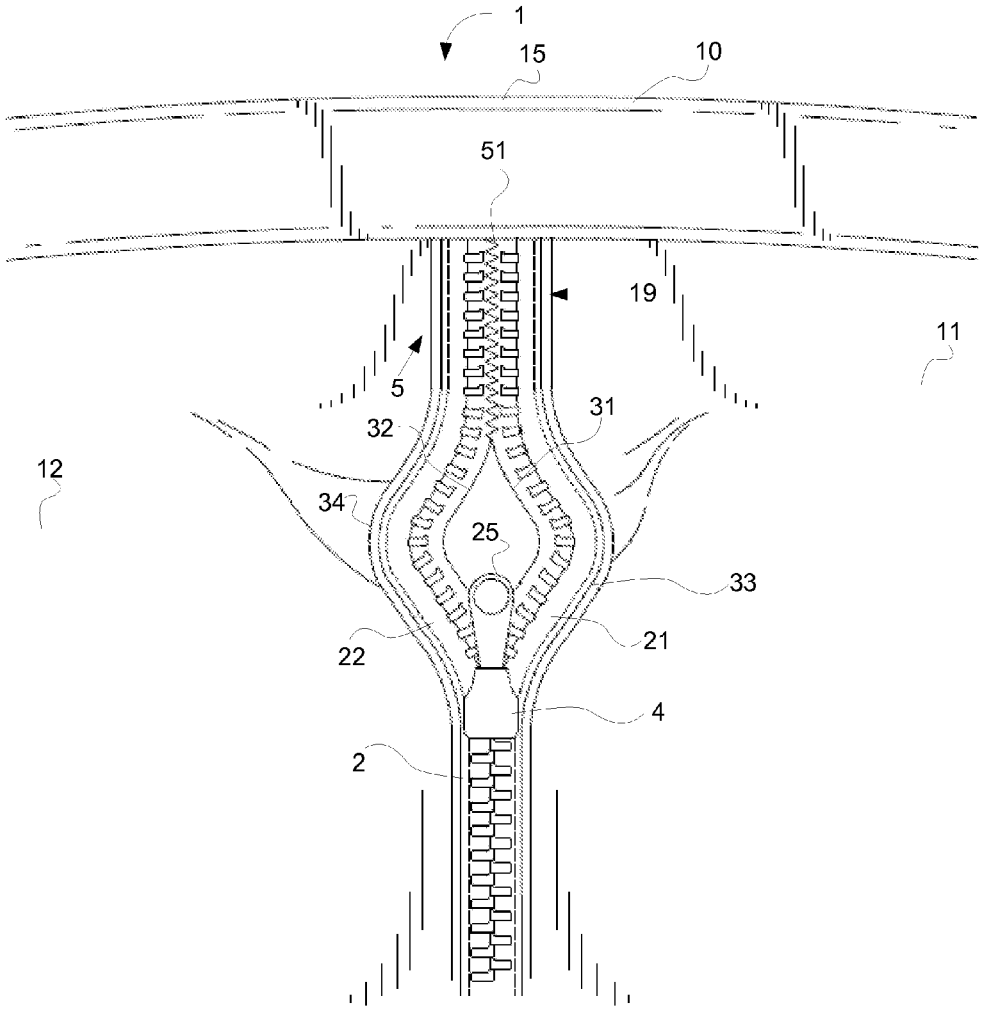
FIGS. 3*a* and 3*b* are an interior view and a top cross-sectional view of a lower body garment with a two slider invisible zipper, in accordance with an embodiment of the invention.
Figure 3B:
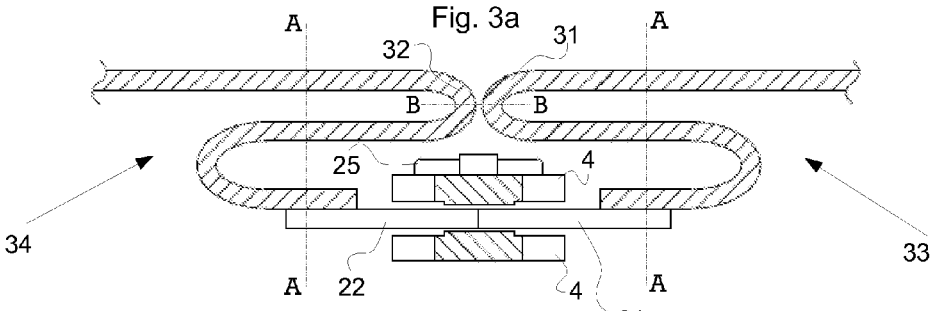

FIGS. 3*a* and 3*b* are an interior view and a top cross-sectional view of a lower body garment with a two slider invisible zipper, in accordance with an embodiment of the invention. FIG. 3*a* is a view of the interior of the garment, looking at the rear of the garment near its top. In some embodiments, the invisible zipper 2 is constructed by coupling the left and right portions 11 and 12 of the garment with the left and right zipper tapes 21 and 22 of the invisible zipper. Particularly, the left and right portions of the garment are folded over at 31 and 32, creating a left interior flap 33 and right interior flap 34. The left and right zipper tapes 21 and 22 are stitched along lines A-A to the left and right interior flaps 33 and 34. This construction defines the invisible zipper 2, in which the left and right interior flaps lay on the exterior of the invisible zipper, making the line along which the invisible zipper runs appear to be a fixed seam and concealing the invisible zipper from exterior view. The sliders (second slider 4 being depicted in FIGS. 3*a* and 3*b*, although this describes how the first slider is concealed as well) slide along the zipper tapes and behind the interior flaps. The zipper pulls (second zipper pull 25 depicted in FIGS. 3*a* and 3*b*, although this describes how the first zipper pull is concealed as well) sit in between the zipper tapes and the interior flaps.

In some embodiments, the compartment 5 is formed just below the rear portion 15 of the waistband 10. The compartment is disposed at the closed position for the second slider 19, and is sized to hide at least the second zipper pull 25 of the second slider 4 when the second slider is at the closed position for the second slider. The compartment is formed by a stitch 51 (stitch 51 being the zig-zag line in between the sides of the chain of the invisible zipper 2 in FIG. 3*a*) that couples the left and right interior flaps 33 and 34 for a length at least as long as the second zipper pull 25. Stitch 51 joins the left and right interior flaps at the folds in the left and right leg portions 31 and 32, along a line B-B.

Figure 4:
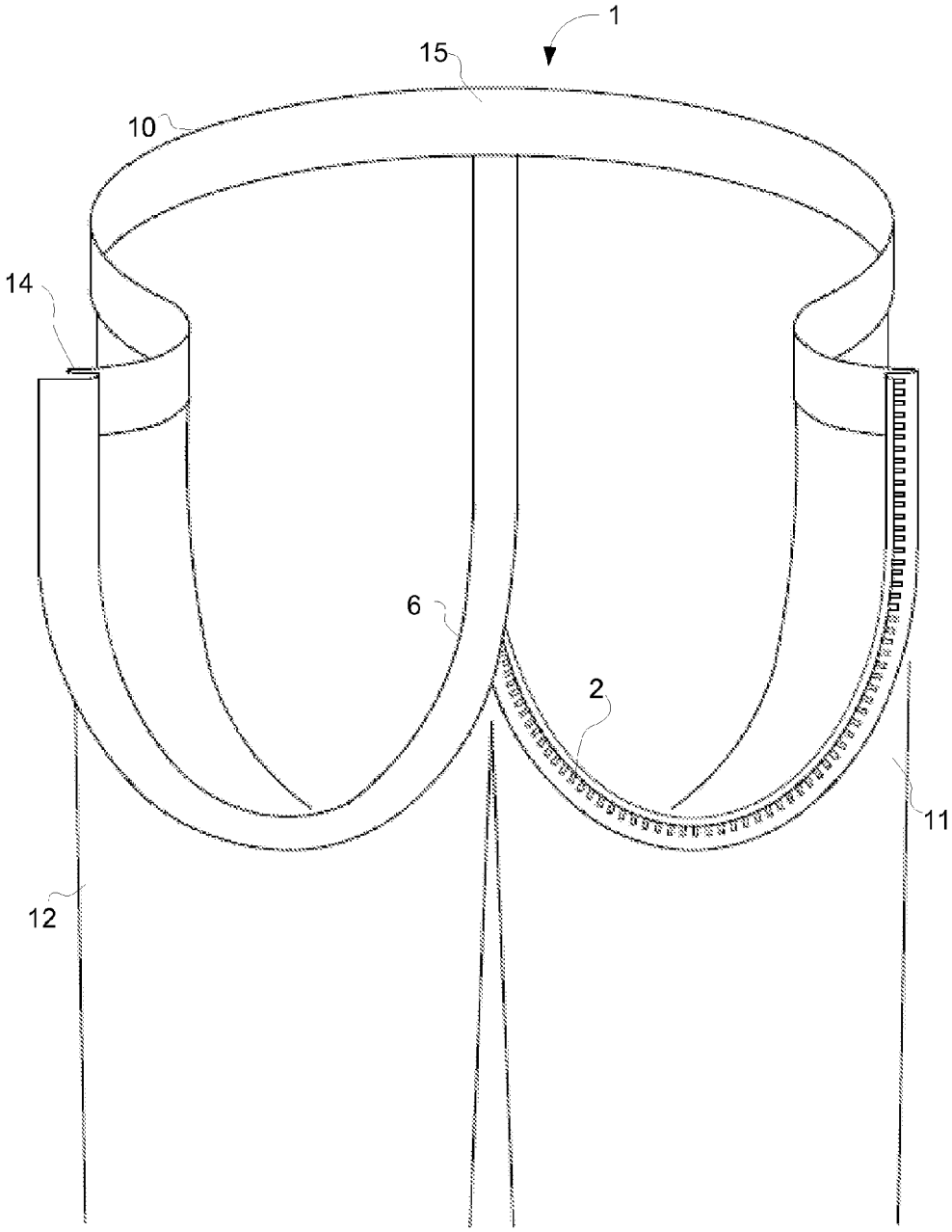
FIG. 4 is a front view of an alternate embodiment of a lower body garment with a two slider invisible zipper, in accordance with an embodiment of the invention.

FIG. 4 is a front view of an alternate embodiment of a lower body garment with a two slider invisible zipper, in accordance with an embodiment of the invention. In some embodiments, an invisible zipper 2 having a chain may chafe if worn directly against the skin of the wearer. Accordingly, a flap 6 may be disposed along the entire length of the invisible zipper 2, from the front 14 of the waistband 10 all the way to the point below the rear 15 of the waistband. The flap 6 may be coupled to either the left leg portion 11 or the right leg portion 12 of the garment 1. In different embodiments without a flap, the wearer may wear an undergarment such as underwear (underwear not pictured) in between the body and the garment 1. In some embodiments, the underwear has an aperture disposed between the legs of the underwear from the front of a waistband of the underwear to the rear of a waistband of the underwear. In some embodiments, the underwear comprises at least a section of the left leg portion and a section of the right leg portion wherein the sections overlap one another, such that the sections can be pulled apart defining the aperture. In some embodiments, the invention comprises a system including the aforementioned underwear and the garment 1, in which a slider of the invisible zipper 2 can be opened and the sections of the underwear are pulled apart, defining an aperture in both the garment 1 and the underwear.

Figure 5:
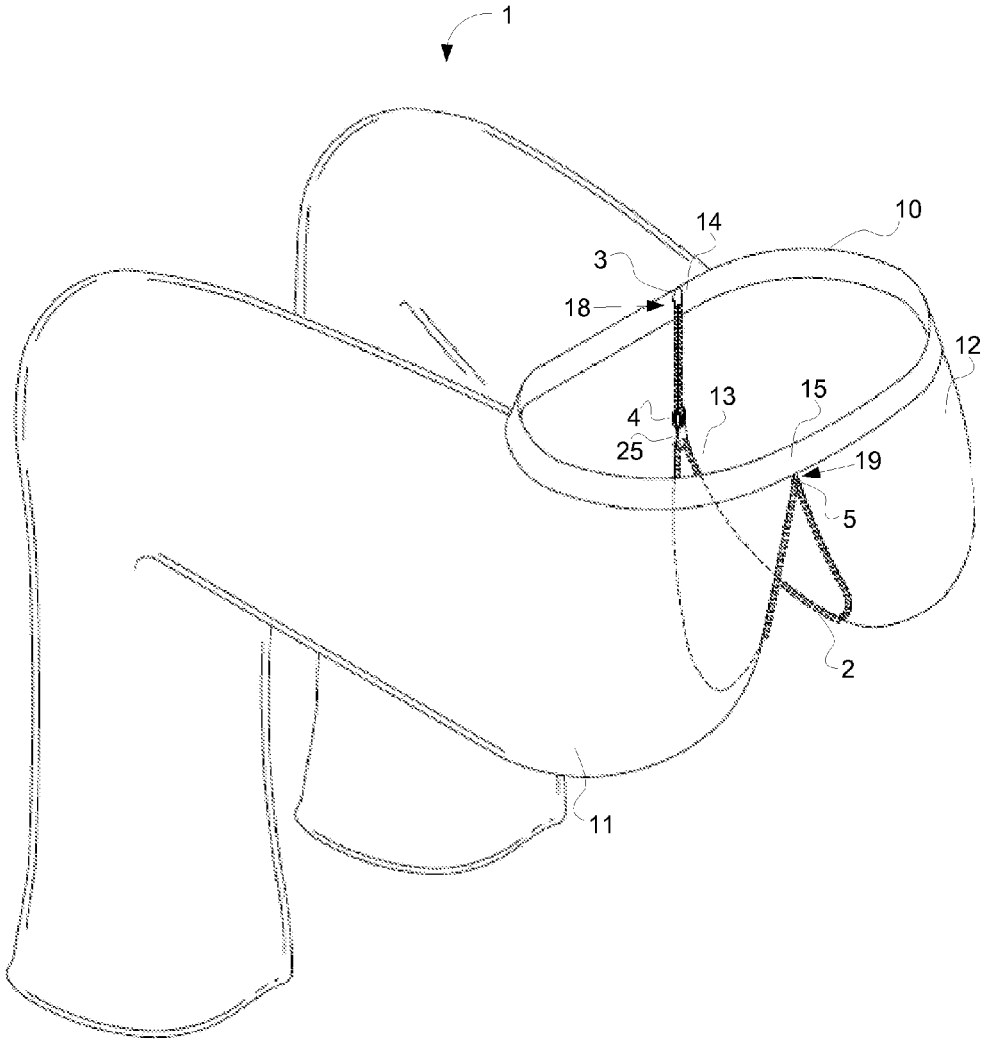
FIG. 5 is a perspective view of a lower body garment with a two slider invisible zipper in accordance with an embodiment of the invention.

FIG. 5 is a perspective view of a lower body garment with a two slider invisible zipper in accordance with an embodiment of the invention. The function and structure of the elements in FIG. 5 are consistent with the descriptions related with respect to FIGS. 1-3.

While preferred and alternative embodiments of the invention have been illustrated and described, as noted above, many changes can be made without departing from the spirit and scope of the invention. Accordingly, the scope of the invention is not limited by the disclosure of these preferred and alternate embodiments. Instead, the invention should be determined entirely by reference to the claims that follow.

What is claimed is:

1. A pair of pants, comprising:

a waistband;

a left leg portion and a right leg portion, the left and right leg portions joined to the waistband, the left and right leg portions partially separable from each other by an invisible zipper, the invisible zipper including at least:

a first slider including at least a first zipper pull;

a second slider including at least a second zipper pull;

a left zipper tape joined to the left leg portion; and a right zipper tape joined to the right leg portion, wherein the invisible zipper is hidden from exterior view via the left and right zipper tapes being stitched into place with corresponding left and right flaps created by at least two opposing folds in each of the left and right leg portions, the left and right flap substantially covering an exterior portion of the invisible zipper when both the first and second sliders of the invisible zipper are closed; and a compartment configured for hiding at least the second zipper pull from exterior view when the second slider is closed, the compartment formed proximate to a rear portion of the waistband via one or more stitches coupling a portion of the left and right flaps for a length at least as long as the second zipper pull, the one or more stitches enabling the second zipper pull to be hidden from exterior view via being tucked into the compartment defined between the stitched portion of the left and right flaps and the left and right zipper tapes when the second slider is closed.

2. The pair of pants of claim 1, wherein the first and second sliders are operable to close the invisible zipper when the first slider is at a first closed position of the invisible zipper and the second slider is at a second closed position of the invisible zipper.

3. The pair of pants of claim 2, wherein the first closed position is an end of the invisible zipper at a front portion of the waistband, and wherein the second closed position is an end of the invisible zipper opposite the first end of the invisible zipper.

4. The pair of pants of claim 3, wherein the second closed position is an end of the invisible zipper opposite the first end of the invisible zipper, the second closed position disposed proximate to a rear portion of the waistband.

5. The pair of pants of claim 1, wherein the invisible zipper is disposed through a center of a crotch portion of the pair of pants, the invisible zipper disposed transversely between the left leg portion and the right leg portion of the pair of pants.

6. The pair of pants of claim 1, wherein the waistband opens at a front portion of the pair of pants.

7. The pair of pants of claim 1, comprising:

an interior flap coupled to one of the left leg portion or the right leg portion, the interior flap configured to cover a zipper chain of the invisible zipper, the interior flap disposed along an entire length of the zipper chain.

8. The pair of pants of claim 1, wherein the first zipper pull and second zipper pull are configured for enabling a wearer to open or close the invisible zipper, the first zipper pull and second zipper pull being sized such that they may be pulled by a wearer wearing one of mittens or gloves.

9. The pair of pants of claim 1, wherein the invisible zipper is a waterproof zipper.

10. The pair of pants of claim 1, wherein the pair of pants includes at least two zipper pulls, the at least two zipper pulls coupled with at least a portion of the invisible zipper.

11. The pair of pants of claim 1, wherein the pair of pants includes at least two sliders.

12. The pair of pants of claim 1, wherein the pair of pants includes at least one invisible zipper.

13. The pair of pants of claim 1, wherein the pair of pants are shorts.

14. The pair of pants of claim 1, wherein the pair of pants is a lower body garment.

15. The pair of pants of claim 1, wherein the first and second sliders are operable to open and shut a zipper chain of the invisible zipper.

16. The pair of pants of claim 1, wherein the invisible zipper defines a seam between the left and right leg portions of the pair of pants.

17. The pair of pants of claim 1, wherein the first and second sliders are configured to slide along an entire length of a zipper chain of the invisible zipper.

18. The pair of pants of claim 1, wherein the left and right flaps are not stitched together below the compartment.

19. The pair of pants of claim 1, wherein the left and right flaps substantially covering an exterior portion of the invisible zipper include at least the left and right flaps laying on the exterior of the invisible zipper.

20. The pair of pants of claim 1, wherein the compartment is disposed at a closed position for the second slider.

* * * * *